US005878610A

United States Patent [19]

Friedrich

[11] Patent Number: 5,878,610

[45] **Date of Patent: *Mar. 9, 1999**

[54] MOTOR VEHICLE DOOR LOCK SYSTEM

[75] Inventor: Hagen Friedrich, Essen, Germany

[73] Assignee: Kiekert AG, Heiligenhaus, Germany

[ * ] Notice: The term of this patent shall not extend beyond the expiration date of Pat. No. 5,862,691.

[21] Appl. No.: 966,461

[22] Filed: Nov. 7, 1997

[30] Foreign Application Priority Data

Nov. 13, 1996 [DE] Germany ..... 196 46 810.8

[51] Int. Cl.[6] ..... E05B 47/00; E05B 65/36

[52] U.S. Cl. ..... 70/264; 70/276; 70/DIG. 30

[58] Field of Search ..... 70/264, 276, 413, 70/DIG. 30; 340/426, 542

[56] References Cited

U.S. PATENT DOCUMENTS

| | | | |
|---|---|---|---|
| 3,124,950 | 3/1964 | Nallinger | 70/264 |
| 4,399,673 | 8/1983 | Gotanda | 70/276 |
| 4,565,994 | 1/1986 | Mochida et al. | 340/542 |
| 4,910,980 | 3/1990 | Katoh | 70/264 X |
| 5,551,267 | 9/1996 | Janssen et al. | 70/276 X |
| 5,566,562 | 10/1996 | Fujii | 70/276 X |

FOREIGN PATENT DOCUMENTS

| | | | |
|---|---|---|---|
| 0 694 665 | 1/1996 | European Pat. Off. . | |
| 2821901 | 12/1978 | Germany | 70/264 |
| 3941086 | 6/1991 | Germany | 70/276 |
| 94 15 257 | 1/1995 | Germany . | |
| 44 33 042 | 10/1995 | Germany . | |
| 195 05 759 | 9/1996 | Germany . | |
| 2187227 | 9/1987 | United Kingdom | 70/277 |
| WO 90/07045 | 6/1990 | WIPO | 70/276 |

*Primary Examiner*—Lloyd A. Gall
*Attorney, Agent, or Firm*—Herbert Dubno

[57] ABSTRACT

A motor vehicle door lock has a key operated lock cylinder signalling antitheft and locking-and-unlocking positions via Hall effect chips which include electronic circuitry working into evaluation circuitry connected to the chips. The chips themselves can be selected from a series of mass produced chips based on criteria including the magnetic thresholds and electrical thresholds of the chips provided that the thresholds of the evaluation circuitry are selected appropriately matching of each chip or its Hall effect element to the system is thoroughly avoided.

3 Claims, 3 Drawing Sheets

MOTOR VEHICLE DOOR LOCK SYSTEM

FIELD OF THE INVENTION

My present invention relates to a motor vehicle door lock system which has a bolt system, i.e. a mechanism for operating the vehicle door bolt, a locking system cooperating with the bolt system and including electrical circuitry which can respond to functional positions of a key-operated lock system, and Hall-effect sensor chips which are the position detectors for the lock cylinder.

BACKGROUND OF THE INVENTION

The kind of motor vehicle door lock with which the invention is concerned can have a bolt system, arrangement or mechanism which is operated in response to an electrical unit which can be termed a locking system and which can have a mechanical lock cylinder operated by a mechanical key, the latter being inserted into the cylinder for rotating same.

The lock cylinder can have three functional positions, namely, an intermediate starting position, a locking-and-unlocking position to one side of the starting position and an anti-theft position to the opposite side of the starting position. Selection between these three positions is made by operation of the key.

The locking cylinder can be provided with evaluation circuitry which can detect the position of the lock cylinder by scanning or the like. The locking system can further include at lest two fixedly mounted Hall-sensor chips each of which can include a Hall-sensor transducer and the associated chip electronics such that the Hall-sensor chip can cooperate with a ferromagnetic actuating magnet operatively connected with the locking cylinder. The starting position can correspond to an intermediate zero setting with respect to the evaluation circuitry which can have a lower electric current threshold $A_1$ and an upper electrical current threshold $A_2$.

Door locks of this type are described, for example, in German Patent Document DE 196 34 321.6 A1 (corresponding to U.S. patent application Ser. No. 08/915, 897, filed Aug. 21, 1997, Attorney's Docket No. 20465), EP 0 694 665 A 1 and German Utility Model 296 18 688.0 U1 (corresponding to U.S. patent application Ser. No. 08/950, 792, filed Oct. 16, 1997, Our Docket No. 20516).

In door locks with two such Hall sensor chips, one usually selects the chips so that they are practically identical, e.g. as described in DE 94 15 257.8 U1. In that case, there must be a predetermined match between the Hall sensor and the chip electronics and the determination of that relationship can be an expensive process.

In practice, Hall sensors and Hall sensor chips as described are mass produced on an industrial scale and both the magnetic and electrical tolerances of the units can be substantial. The Hall sensor chips can be manufactured, for example, in series with fabrication tolerances which are more or less identical for a particular series. To a particular series, for example, magnetic and electronic function parameters with upper and lower limits for operability can be ascribed which will not be exceeded or below which the parameters will not fall.

However, up to now, as far as I am aware, the fact that Hall sensor chips are fabricated in such series with well defined upper and lower limits has not been utilized to overcome the drawbacks involved in selecting and matching both the magnetic and electronic components of usable Hall sensor chips for these purposes.

OBJECTS OF THE INVENTION

It is, therefore, the principal object of the invention to provide an improved motor vehicle door lock which can allow the use of Hall sensor chips from a mass production series without requiring expensive and complex matching and testing procedures.

Still another object of the invention is to provide a motor vehicle door lock which obviates the difficulties hitherto encountered with the use of Hall sensor chips in an economical fashion.

SUMMARY OF THE INVENTION

These objects are attained, in accordance with the invention in a bolt system and a locking system operatively connected with the bolt system, the locking system having a mechanical lock cylinder cooperating with a cylinder-operating key, the lock cylinder having three positions into a selected one of which the key can displace the cylinder and including an intermediate starting position, a locking-and-unlocking position to one side of the starting position and an antitheft position on an opposite side of the starting position, and evaluation circuitry connected with the locking system for detecting the selected one of the positions, the evaluation circuitry including at least two fixedly mounted Hall sensor chips with respective chip electronics and a ferromagnetic element displaceable by the lock cylinder, the evaluation circuitry establishing an intermediate zero setting at the starting position, a lower electrical current threshold $A_1$ and an upper electrical current threshold $A_2$.

(1.1) The Hall sensor chips both are selected from a production series of identically fabricated chips with fabrication-determined functional tolerances of the magnetic operating field strength between magnetic thresholds $M_1$ and $M_2$ wherein $M_1$ is a lower limit and $M_2$ is an upper limit of the operating field strength for the series from which the Hall sensor chips were selected, and fabrication-determined functional tolerances of the electrical thresholds $E_1$ and $E_2$ of the chip electronics corresponding to the thresholds $M_1$ and $M_2$ wherein $E_1$ is a maximum value of the starting current in the intermediate starting position of the ferromagnetic element and $E_2$ is the minimum value of the starting current in the locking-and-unlocking position of the ferromagnetic element for the series from which both Hall sensor chips are selected.

(1.2) The selected Hall sensor chips are assigned as antitheft and locking-and-unlocking position sensors for the lock cylinder independently of the respective magnetic thresholds of the selected Hall sensor chips.

(1.3) The ferromagnetic element is a layered magnet located at a distance of about one millimeter from both of the Hall sensor chips in the starting position.

(1.4) The evaluation circuitry is so configured that the lower electrical current threshold $A_1$ is above the electrical threshold $E_1$ and the upper electrical current threshold is below the electrical threshold $E_2$ in the locking-and-unlocking position or antitheft position.

The invention is based upon the fact that door locks of the aforedescribed type are fabricated in comparatively large numbers for a particular vehicle type. As a consequence, it is important that not only the door lock in its entirety but also its components and the evaluation circuitry used, independently of the functional positions of the door lock, be available by mass production. This, of course, applies also to the Hall sensor chips.

When the conditions set forth have been followed, then it is possible, in accordance with point 1.1 to select a Hall sensor chip from such a series without any regard to specific testing of that chip or without any need for an expensive matching step (see point 1.2). When point 1.3 is additionally ensured, the function of the Hall sensor is guaranteed to be reliable.

Since the invention eliminates the need for matching the Hall sensors and their electronic circuitry for the specific tasks, optional reliability is increased while costs are reduced. The Hall sensor chips need not be sorted or selected by any particular criteria, need not be matched with one another before use and, furthermore, with the system in the starting position, the starter battery which supplies the Hall sensor chips directly or indirectly with electrical energy, has minimum drain.

The use of magnetic systems for signalling lock position or status frequently, in the past, has allowed manipulation of the lock by a foreign magnet without switching of the system from the antitheft position. In a system of the invention utilizing points 1.1, 1.2 and 1.3, the ability to manipulate the system with a foreign magnet and to switch the system by acting upon the lock-and-unlocking sensor can be suppressed where the ferromagnetic element has a portion juxtaposable with the sensor in the locking-and-unlocking position and of a magnetic field strength sufficiently high so that, in the starting position, a difference between the magnetic field strength of the portion and a lower field strength of a conventional magnet brought into proximity of the door lock in an attempt to manipulate the sensor in the locking-and-unlocking position is greater than the magnetic threshold $M_2$.

Of course a combination of the latter with point 1.4 is also conceivable in accordance with the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
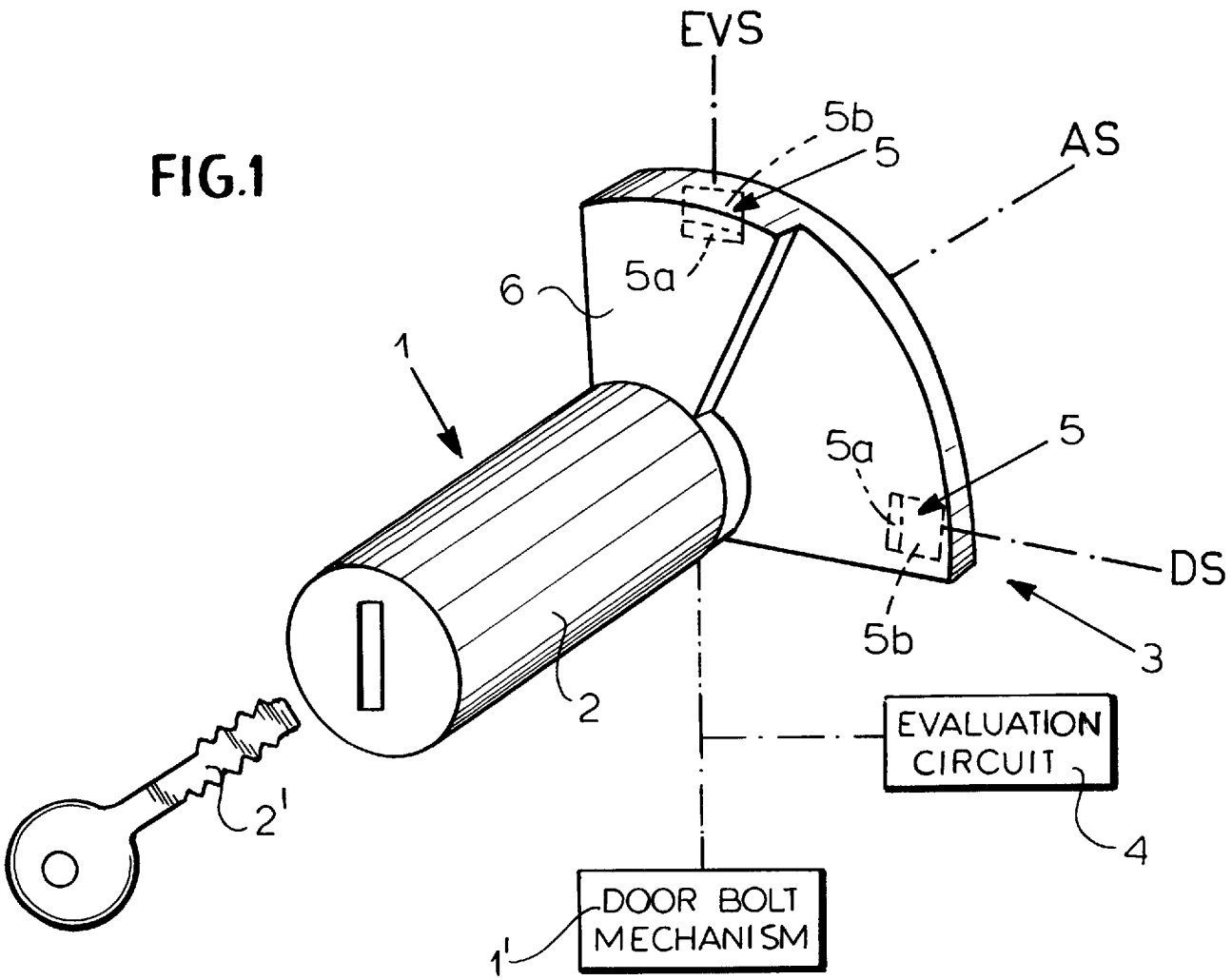
FIG. 1 is a fragmentary view of a door lock system showing only parts essential to the invention and illustrating in block form all other parts common or necessary for the vehicle door lock.

FIG. 1 shows a vehicle door lock system which comprises a door bolt mechanism 1' and a locking system 1 for operating that door bolt mechanism which, like any other electrically operated vehicle door bolt system, can comprise a rotary bolt, a keeper, a locking lever system, an actuating lever system with an external operating lever and on internal operating lever and the usual rotors or actuators operatively connected with those levers. The locking system 1 itself comprises a mechanical locking cylinder 2 with which a key 2' can cooperate, the mechanical key being capable of rotating the locking cylinder 2 selectively into one of three positions, namely, an intermediate starting position AS, a lock-and-unlocking position EVS on one side of the starting position AS and an antitheft position DS on the opposite side of the starting position AS. Intermediate starting position is simultaneously a rest position in which the key can be inserted in the cylinder 2 and removed therefrom. The key can rotate the cylinder to the left or to the right to bring about the other functional positions. In the antitheft position the key can also be removed.

The system also comprises a device 3 for detecting the selected functional position of the lock cylinder and for this purpose a schematically illustrated evaluation circuit 4 can be provided.

That circuit cooperates with two fixedly mounted Hall sensor chips 5 each of which can include a Hall sensor 5*a* and an integrated circuit 5*b* forming the chip electronics.

Figure 2:
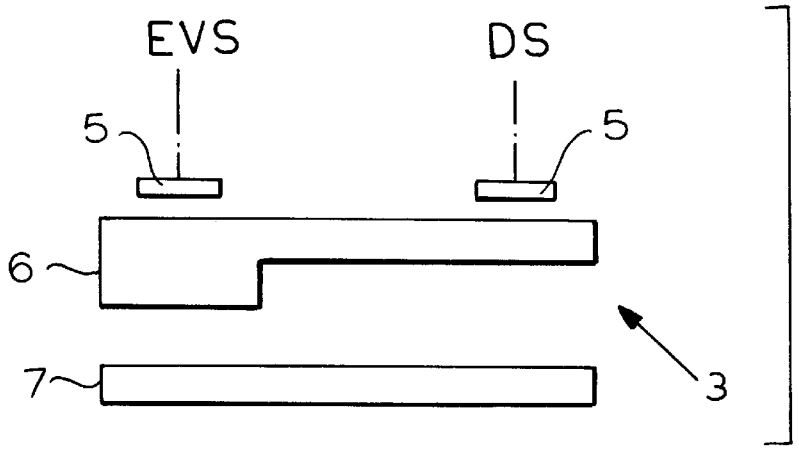
FIG. 2 is a diagram illustrating details of the means for detecting the functional positions of the lock cylinder.
Figure 3:
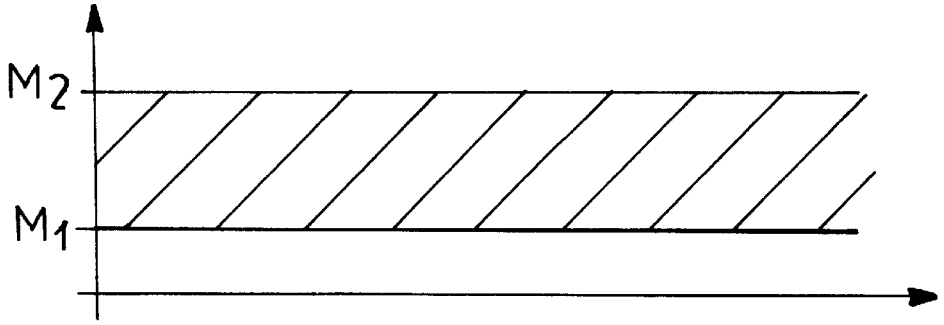
FIG. 3 is a graph showing the magnetic thresholds of the Hall sensor chips.
Figure 4:
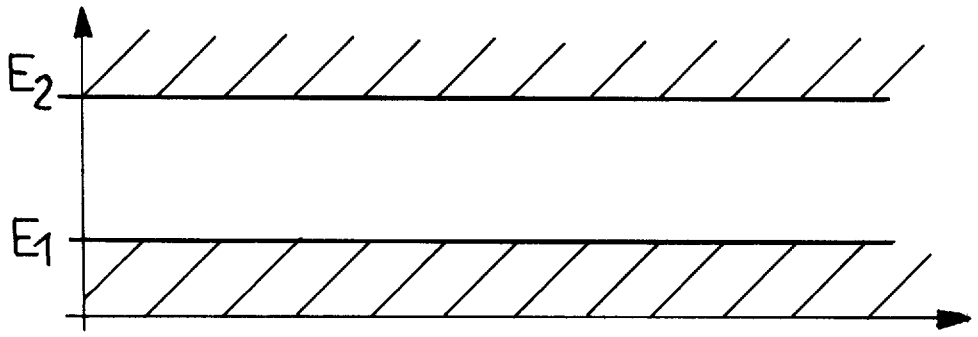
FIG. 4 is a graph showing the electrical thresholds of the chip electronics.

Reference can be made to FIG. 2 in which the chips 5 are shown to be juxtaposed with an actuating element 6 which is in the form of a ferromagnetic element 6, displaceable by the lock cylinder. The arrangement is such that the starting position AS corresponds to an intermediate zero setting of the evaluation circuit 4. The latter can have a lower electrical current threshold $A_1$ and an upper electrical current threshold $A_2$ represented in FIG. 5 and described in greater detail below. The two Hall sensor chips are selected from the series of such chips produced by mass production and which in the sense of mass production are identical, having functional tolerances determined on fabrication with reference to the actuating field strength. The chips thus have thresholds $M_1$ and $M_2$ as illustrated in FIG. 3. The threshold $M_1$ is the lower limit for the series from which the two Hall sensor chips are chosen with which the chips are responsive while $M_2$ represents the upper limit of the operating range for the series from which the two Hall sensor chips are selected. The Hall sensor chips 5 have respective chip electronics which have electrical thresholds $E_1$ and $E_2$ as shown in FIG. 4. The threshold $E_1$ is the maximum value of the output current in the intermediate zero starting position AS of the ferromagnetic actuating element 6 for the series from which the two Hall sensor chips are selected. $E_2$ is the minimum value of the output current in the lock-and-unlock position EVS of the ferromagnetic actuating element 6.

One of the two Hall sensor chips is selected to be the locking-and-unlocking position sensor while the other is selected and positioned to be the antitheft position sensor. The sensors used and their positioning are independent of the specific magnetic thresholds $M_1$ and $M_2$ of the Hall sensor chips.

Figure 5:
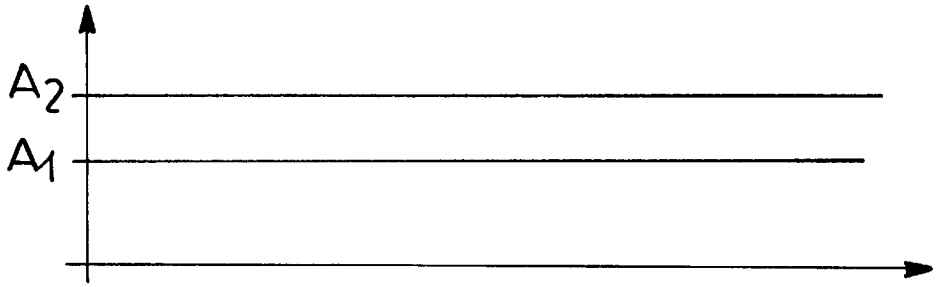
FIG. 5 is a graphic illustration of the electrical current thresholds of the evaluation circuitry.

The ferromagnetic actuating element 6 is a layered magnet element which in the starting position AS has a spacing from the two Hall sensor chips 5 which is of the order of a millimeter. FIG. 5 shows the thresholds $A_1$ and $A_2$ of the evaluating circuitry 4. As can be seen from FIG. 6, the evaluating circuitry 4 is so configured that its lower electrical current threshold $A_1$ is above the maximum value of the output current $E_1$ of the chip electronic in the starting position AS and its upper electrical current threshold $A_2$ is below the minimum value of the starting current in the locking-and-unlocking position EVS or the antitheft position DS or one of these positions.

Figure 6:
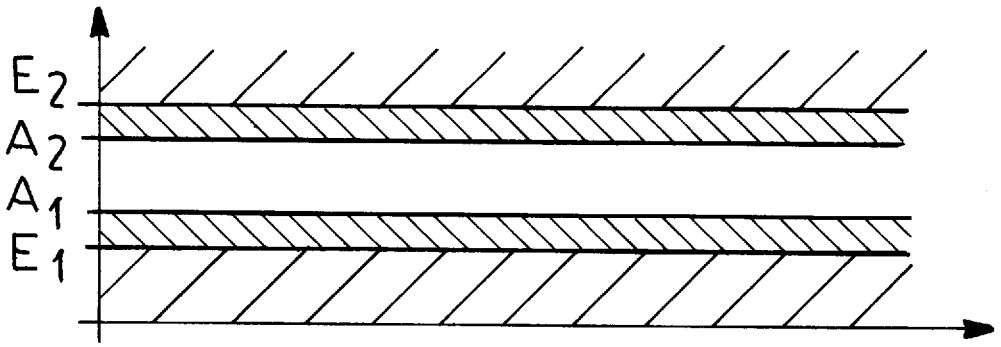
FIG. 6 is a combination of the graphs of FIGS. 4 and 5 illustrating the conditions referred to in accordance with the invention.

FIG. 6 displays the electrical thresholds superimposed on one another and from this figure it will be apparent that the Hall sensor chips do not have to be especially selected or matched in a conventional way, as long as the above conditions are fulfilled.

FIG. 2 shows that the actuating magnet 6 can have regions of different thicknesses. The thicker region represents a region of greater field strength than that of the thinner region and the thicker region is juxtaposed with the Hall sensor chip located in the lock-and-unlocking position and the lock-and-unlocking sensor. The thinner region is juxtaposed with the chip 5 serving as the antitheft sensor.

To avoid manipulation of the locking-and-unlocking sensor by a conventional foreign magnet 7, the magnetic field strength of the part of the magnetic element 6 juxtaposed with the locking-and-unlocking sensor is made so high that in the starting position AS, the difference between the higher field strength of this position of the magnetic element 6 and the lower field strength of the external magnet 7 in the region of the locking-and-unlocking sensor lies above the field strength for the upper limit of the magnetic threshold $M_2$.

Basically the Hall sensor chips can have commercial configurations satisfying the foregoing requirements. In the starting position of the ferromagnetic element 6 i.e. in the intermediate zero position, the output current of the Hall sensor chip is low. In the lock-and-unlocking position of the magnetic actuator, the output current of the Hall sensor chip is high. The threshold $E_1$ (maximum value of the output current) in the starting position is then lower than the threshold $E_2$ (minimum value of the starting current in the locking and unlocking position) as a consequence, the Hall sensor chips will reliably signal the positions. The thresholds are output signals of the sensor chips which can trigger switching operations.

As is conventional, each Hall sensor chip can include a conventional Hall plate or element, usually of an appropriate semiconductor, embedded in a synthetic resin and in which the chip electronics is also embedded in the form of an integrated electronic component configured to provide the switching function and usually including an amplifier, a semiconductor switch and a comparator. The Hall effect and its application to switching functions and associated switching functions are all well known as are the evaluation circuitry which can be used in conjunction therewith.

I claim:

1. A motor-vehicle door lock comprising a bolt system and a locking system operatively connected with the bolt system, the locking system having a mechanical lock cylinder cooperating with a cylinder-operating key, said lock cylinder having three positions into a selected one of which the key can displace the cylinder and including an intermediate starting position, a locking-and-unlocking position to one side of said starting position and an antitheft position on an opposite side of said starting position, and evaluation circuitry connected with the locking system for detecting the selected one of said positions, said evaluation circuitry including at least two fixedly mounted Hall sensor chips with respective chip electronics and a ferromagnetic element displaceable by said lock cylinder, said evaluation circuitry establishing an intermediate zero setting at said starting position, a lower electrical current threshold $A_1$ and an upper electrical current threshold $A_2$, the Hall sensor chips both being selected from a production series of identically fabricated chips with fabrication-determined functional tolerances of the magnetic operating field strength between magnetic thresholds $M_1$ and $M_2$ wherein $M_1$ is a lower limit and $M_2$ is an upper limit of the operating field strength for the series from which the Hall sensor chips were selected, and fabrication-determined functional tolerances of the electrical thresholds $E_1$ and $E_2$ of the chip electronics corresponding to the thresholds $M_1$ and $M_2$ wherein $E_1$ is a maximum value of the starting current in the intermediate starting position of the ferromagnetic element and $E_2$ is the minimum value of the starting current in the locking-and-unlocking position of the ferromagnetic element for the series from which both Hall sensor chips are selected;

the selected Hall sensor chips are assigned as antitheft and locking-and-unlocking position sensors for the lock cylinder independently of the respective magnetic thresholds of the selected Hall sensor chips;

the ferromagnetic element is a layered magnet located at a distance of about one millimeter from both of the Hall sensor chips in said starting position; and said evaluation circuitry is so configured that said lower electrical current threshold $A_1$ is above the electrical threshold $E_1$ and said upper electrical current threshold is below the electrical threshold $E_2$ in the locking-and-unlocking position or antitheft position.

2. A motor-vehicle door lock comprising a bolt system and a locking system operatively connected with the bolt system, the locking system having a mechanical lock cylinder cooperating with a cylinder-operating key, said lock cylinder having three positions into a selected one of which the key can displace the cylinder and including an intermediate starting position, a locking-and-unlocking position to one side of said starting position and an antitheft position on an opposite side of said starting position, and evaluation circuitry connected with the locking system for detecting the selected one of said positions, said evaluation circuitry including at least two fixedly mounted Hall sensor chips with respective chip electronics and a ferromagnetic element displaceable by said lock cylinder, said evaluation circuitry establishing an intermediate zero setting at said starting position, a lower electrical current threshold $A_1$ and an upper electrical current threshold $A_2$ , the Hall sensor chips both being selected from a production series of identically fabricated chips with fabrication-determined functional tolerances of the magnetic operating field strength between magnetic thresholds $M_1$ and $M_2$ wherein $M_1$ is a lower limit and $M_2$ is an upper limit of the operating field strength for the series from which the Hall sensor chips were selected, and fabrication-determined functional tolerances of the electrical thresholds $E_1$ and $E_2$ of the chip electronics corresponding to the thresholds $M_1$ and $M_2$ wherein $E_1$ is a maximum value of the starting current in the intermediate starting position of the ferromagnetic element and $E_2$ is the minimum value of the starting current in the locking-and-unlocking position of the ferromagnetic element for the series from which both Hall sensor chips are selected;

the selected Hall sensor chips are assigned as antitheft and locking-and-unlocking position sensors for the lock cylinder independently of the respective magnetic thresholds of the selected Hall sensor chips;

the ferromagnetic element is a layered magnet located at a distance of about one millimeter from both of the Hall sensor chips in said starting position; and said ferromagnetic element has a portion juxtaposable with said sensor in said locking-and-unlocking position and of a magnetic field strength sufficiently high so that, in said starting position, a difference between the magnetic field strength of said portion and a lower field strength of a conventional magnet brought into proximity of said door lock in an attempt to manipulate said sensor in said locking-and-unlocking position is greater than said magnetic threshold $M_2$.

3. A motor-vehicle door lock comprising a bolt system and a locking system operatively connected with the bolt system, the locking system having a mechanical lock cylinder cooperating with a cylinder-operating key, said lock cylinder having three positions into a selected one of which the key can displace the cylinder and including an intermediate starting position, a locking-and-unlocking position to one side of said starting position and an antitheft position on an opposite side of said starting position, and evaluation circuitry connected with the locking system for detecting the selected one of said positions, said evaluation circuitry including at least two fixedly mounted Hall sensor chips with respective chip electronics and a ferromagnetic element displaceable by said lock cylinder, said evaluation circuitry establishing an intermediate zero setting at said starting position, a lower electrical current threshold $A_1$ and an upper electrical current threshold $A_2$, the Hall sensor chips both being selected from a production series of identically fabricated chips with fabrication-determined functional tolerances of the magnetic operating field strength between magnetic thresholds $M_1$ and $M_2$ wherein $M_1$ is a lower limit and $M_2$ is an upper limit of the operating field strength for the series from which the Hall sensor chips were selected, and fabrication-determined functional tolerances of the electrical thresholds $E_1$ and $E_2$ of the chip electronics corresponding to the thresholds $M_1$ and $M_2$ wherein $E_1$ is a maximum value of the starting current in the intermediate starting position of the ferromagnetic element and $E_2$ is the minimum value of the starting current in the locking-and-unlocking position of the ferromagnetic element for the series from which both Hall sensor chips are selected;

the selected Hall sensor chips are assigned as antitheft and locking-and-unlocking position sensors for the lock cylinder independently of the respective magnetic thresholds of the selected Hall sensor chips;

the ferromagnetic element is a layered magnet located at a distance of about one millimeter from both of the Hall sensor chips in said starting position;

said evaluation circuitry is so configured that said lower electrical current threshold $A_1$ is above the electrical threshold $E_1$ and said upper electrical current threshold is below the electrical threshold $E_2$ in one of the locking-and-unlocking position or antitheft position; and said ferromagnetic element has a portion juxtaposable with said sensor in said locking-and-unlocking position and of a magnetic field strength sufficiently high so that, in said starting position, a difference between the magnetic field strength of said portion and a lower field strength of a conventional magnet brought into proximity of said door lock in an attempt to manipulate said sensor in said locking-and-unlocking position is greater than said magnetic threshold $M_2$.

* * * * *